US005450169A

United States Patent [19]

Hart et al.

[11] Patent Number: 5,450,169

[45] Date of Patent: Sep. 12, 1995

[54] MULTI-LOBE MAGNETIC SEALS

[75] Inventors: Steven C. Hart, Webster; Victoria F. DeYoung, Rochester; Jorge A. Alvarez, Webster, all of N.Y.

[73] Assignee: Xerox Corporation, Stamford, Conn.

[21] Appl. No.: 264,821

[22] Filed: Jun. 23, 1994

[51] Int. Cl.[6] ..... G03G 21/00

[52] U.S. Cl. ..... 355/215; 355/245

[58] Field of Search ..... 355/215, 245, 257, 251, 260; 277/12, 80; 118/653, 657, 658

[56] References Cited

U.S. PATENT DOCUMENTS

| | | | |
|---|---|---|---|
| 3,788,275 | 1/1974 | Hanson | 118/637 |
| 4,040,386 | 8/1977 | Smith | 118/653 |
| 4,213,617 | 7/1980 | Salger | 277/12 |
| 4,293,137 | 10/1981 | Ezekiel | 277/80 |
| 4,616,919 | 10/1986 | Adley et al. | 355/245 |
| 4,878,088 | 10/1989 | Nakanishi et al. | 355/253 |
| 4,936,249 | 6/1990 | Tajima et al. | 355/251 |
| 5,084,733 | 1/1992 | Katoh et al. | 355/251 |
| 5,177,536 | 1/1993 | Watanabe et al. | 355/215 X |
| 5,187,326 | 2/1993 | Shirai | 355/251 |
| 5,202,729 | 4/1993 | Miyamoto et al. | 355/251 |
| 5,202,739 | 4/1993 | Hatakeyama et al. | 355/327 |
| 5,239,343 | 8/1993 | Sakemi et al. | 355/253 |
| 5,267,007 | 11/1993 | Watanabe et al. | 355/215 X |
| 5,287,148 | 2/1994 | Sakemi et al. | 355/245 |

*Primary Examiner*—William J. Royer

*Attorney, Agent, or Firm*—John S. Wagley

[57] ABSTRACT

A system for sealing a member mounted in a support to rotate about an axis thereof and being at least partially in a chamber of a housing with magnetic particles being disposed at least in a region between the housing and the member. The system includes a magnetic member including a plurality of magnetic poles with magnetization axes extending in a direction substantially transverse to the axis of the member.

24 Claims, 7 Drawing Sheets

MULTI-LOBE MAGNETIC SEALS

The present invention relates to a developer apparatus for electrophotographic printing. More specifically, the invention relates to a seal for sealing journals within a development system.

Cross reference is made to the following application filed concurrently herewith: U.S. application Ser. No. 08/264,397 , entitled "External Development Housing Bearings", by C. G. Edmunds et al.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner."Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development."The object of effective development of a latent image on the photoreceptor is to convey developer material to the latent image at a controlled rate so that the developer material effectively adheres electrostatically to the charged areas on the latent image. At a development station, a development system or developer unit develops the latent image recorded on the photoconductive surface. A chamber in a developer housing stores a supply of developer material. To convey the developer material in the chamber to the latent image and to mix and triboelectrically charge the developer, a series of augers and magnetic rollers are strategically placed in the chamber and supported by the developer housing. Since these augers and rollers rotate, bearings are used to support the rollers at the housing.

A typical prior art developer bearing arrangement is shown in FIG. 4. An apparatus 10 for sealing a shaft or journal 16 of an auger 17 includes a magnetic seal 11 which is located inboard from a bearing 12. The bearing 12 is typically a sealed ball bearing having lip seal on both sides thereof. The auger 17 is located in a chamber formed by a developer housing 15. The chamber contains developer material which is transported, agitated, and triboelectrically charged by auger 17. The auger journal 16 extends from auger 17 through an opening in the developer housing 15. The magnetic seal 11 is located in the opening adjacent the chamber. The bearing 12 is located adjacent an outer face of the developer housing 15. Magnetized carrier granules 14 are magnetically attracted to the magnetic seal 11 and form a barrier in the opening of the housing 15 surrounding the journal 16.

If the bearing does not use grease, the lip seals may not be absolutely necessary. However, the magnetic seals are not completely effective in containing the toner or carrier. When vibrations and mechanical forces are present in the developer housing, the magnetic attraction of the beads to the magnet are not sufficient to overcome the vibrations and mechanical forces and toner or carrier beads will pass through the seal.

As the journal rotates in the housing, the magnetic seals cooperating with the electrically conductive journal generate eddy currents that further contribute to the heating problem. Further carrier beads collect around the outer edge and face of the magnetic seal where the magnetic field is weaker and frequently the magnetic attractive forces are insufficient to contain them on the seal and they migrate into the bearing causing bearing failure and requiring the beads to be replenished.

As more compact copiers and printers are produced, the developer housings become smaller and the augers and rollers rotate more swiftly aggravating the aforementioned heating problem. Temperature rise within development bearings generally rises linearly with the speed of the shaft. Color printers and copiers which usually require a plurality of developer housings particularly use small developer housings and small swiftly rotating rollers and augers. To complicate the problems with heating in color printers and copiers, the smaller toners used in color copiers are more susceptible to agglomerates and streaking.

The heat from development bearings in development systems utilizing hybrid scavengeless development is particularly a concern. The purpose and function of scavengeless development are described more fully in, for example, U.S. Pat. No. 4,868,600 to Hays et al., U.S. Pat. No. 4,984,019 to Folkins, U.S. Pat. No. 5,010,367 to Hays, or U.S. Pat. No. 5,063,875 to Folkins et al. U.S. Pat. No. 4,868,600 is incorporated herein by reference. In a scavengeless development system, toner is detached from the donor roll by applying AC electric field to self-spaced electrode structures, commonly in the form of wires positioned in the nip between a donor roll and photoreceptor. This forms a toner powder cloud in the nip and the latent image attracts toner from the powder cloud thereto. The lower melting point of color toners and the greater sensitivity of colors to streaking in the color application of HSD make the generation of heat from the development bearings particularly harmful. Furthermore, the agglomerates form toner fibers in HSD and collect on the electrode wires utilized to form the toner powder cloud. These toner fibers formed by heating the developer cause streaking to occur on the document and may damage the electrode wires. Also, the donor roll in HSD runs at much greater rotational speed than the magnetic rollers in magnetic brush development, the higher speed donor roll being a source of great heat.

The following disclosures may be relevant to various aspects of the present invention:

U.S. Pat. No. 5,239,343
Patentee: Sakemi et al.
Issue Date: Aug. 24, 1993
U.S. Pat. No. 5,202,739
Patentee: Hatakeyama et al.
Issue Date: Apr. 13, 1993
U.S. Pat. No. 5,202,729
Patentee: Miyamoto et al.

Issue Date: Apr. 13, 1993
U.S. Pat. No. 5,187,326
Patentee: Shirai
Issue Date: Feb. 16, 1993
U.S. Pat. No. 5,084,733
Patentee: Katoh et al.
Issue Date: Jan. 28, 1992
U.S. Pat. No. 4,936,249
Patentee: Tajima et al.
Issue Date: Jun. 26, 1990
U.S. Pat. No. 4,878,088
Patentee: Nakanishi et al.
Issue Date: Oct. 31, 1989
U.S. Pat. No. 4,616,919
Patentee: Adley et al.
Issue Date: Oct. 14, 1986
U.S. Pat. No. 4,040,386
Patentee: Smith
Issue Date: Aug. 9, 1977
U.S. Pat. No. 3,788,275
Patentee: Hanson
Issue Date: Jan. 29, 1974

The relevant portions of the foregoing disclosures may be briefly summarized as follows:

U.S. Pat. No. 5,239,343 discloses a developing apparatus including a developer layer thickness regulating zone downstream of one of the magnetic poles of a stationary magnet disposed inside a developing sleeve, with respect to the rotational direction of the sleeve. In the regulating zone, there are provided a magnetic member and a nonmagnetic member to regulate the layer thickness of the developer containing magnetic carrier particles and toner particles on the sleeve. The magnetic member has a width of not less than 1 mm and not more than 10 mm and a thickness of not less than 0.2 and not more than 3 mm.

U.S. Pat. No. 5,202,739 discloses an image forming apparatus with a device for forming an electrostatic image on an image bearing member. A developer develops a latent image formed on the image bearing member and includes a developing unit having a developer carrying member for carrying thereon and supplying a developer to the image bearing member. A moving member moves the developing unit between an operative position and a non-operative position away therefrom. A supporting member supports the developing unit for rotation about an axis.

U.S. Pat. No. 5,202,729 discloses a developing apparatus having a container for containing a one component developer, and a rotatable developing roller disposed facing an image bearing member to carry developer from the container to a development zone where it is supplied to an electrostatic latent image carried on an image bearing member. The developing roller includes a metal base member and a resin coating layer thereon in which fine conductive particles are dispersed. A sealing member is provided for preventing leakage of the developer from the container at the end of the developing roller, the sealing member being faced to the end region of the developing roller.

U.S. Pat. No. 5,187,326 discloses a developing apparatus including a container for containing a developer including magnetic particles. A rotatable developer carrying member is disposed in the container and faced to an image bearing member, for carrying the developer to a developing zone. A magnet is provided in the developer carrying member, and a magnetic sealing member is disposed adjacent to and in a rotational direction of the developer carrying member in a region inside of the container adjacent a longitudinal end of the developer carrying member, wherein the magnetic sealing member cooperates with the magnet to form a magnetic field effective to form a magnetic brush of the developer between the magnetic sealing member and the developer carrying member.

U.S. Pat. No. 5,084,733 discloses a developing apparatus including a developer carrying member for carrying a developer, a magnet disposed in the developer carrying member, and an elastic regulating member contacting the developer carrying member to regulate a thickness of a layer of the developer formed on the developer carrying member. The developer carrying member has a roughened surface over a width thereof larger than a width of the portion of the elastic regulating member contacting the developer carrying member while the magnet forms a magnetic field in a marginal region of the roughened surface of the developer carrying member not contacting the elastic regulating member to remove magnetic developer.

U.S. Pat. No. 4,936,249 discloses a developing apparatus which includes a cylindrical member having an outer diameter of 5–25 mm to carry a developer. In the cylindrical member, there is disposed a stationary magnet having only two magnetic poles adjacent an outer periphery thereof. An elastic member is contacted to the cylindrical member to regulate the thickness of the developer layer.

U.S. Pat. No. 4,878,088 discloses a developing unit of an electrophotographic apparatus for developing an electrostatic latent image formed on an image forming member, by electrostatically adsorbing powder developer onto the latent image. The developing unit includes a screw provided with paddles or grooves, each having a helix angle with respect to an axis of the screw, the screw transferring and supplying the powder developer stored in a developer reservoir to the developing roller. The developing unit also includes a blade for regulating a layer thickness of the powder developer to be transferred to the image forming member and a flow regulating plate for biasing a flow of powder developer.

U.S. Pat. No. 4,616,919 discloses a sealing apparatus in a magnetic brush development device which is located in a non-contact fashion between the photoconductive drum and the magnetic brush roll. The seal has a plurality of ridges along the length of the seal that creates a differential air flow under the rotating photoconductive drum. This differential air flow prevents toner dust and bead carryout from axially migrating past the end of the photoconductive and magnetic roll.

U.S. Pat. No. 4,040,386 discloses an electrostatographic processor which has a development system which is equipped with a split housing and with retractable edge seals which may be moved toward and away from the imaging surface of the processor independently of the housing for the development system.

U.S. Pat. No. 3,788,275 discloses a device in which a magnetic flux field forms a shield of magnetic granules about a shaft member journaled for rotary movement. The shield is arranged to prevent contamination of the shaft member. Means for impelling the granules entrapped by the shield away from the bearing in the form of spiral grooves in a rotating member is also provided.

According to the present invention, there is provided a system for sealing a member mounted in a support to rotate about an axis thereof and being at least partially in a chamber of a housing with magnetic particles being disposed at least in a region between the housing and the member. The system comprises a magnetic member including a plurality of magnetic poles with magnetization axes extending in a direction substantially transverse to the axis of the member.

According to the present invention, there is also provided a developer unit comprising a housing defining a chamber for storing a supply of magnetic particles therein and a member having an axis. The developer unit also comprises means for supporting the member at least partially in the chamber of the housing for rotation substantially about the axis thereof and a magnetic member. The magnetic member includes a plurality of magnetic poles with magnetization axes extending in a direction substantially transverse to the axis of the member to form a seal of magnetic particles between the housing and the member to prevent contaminants from reaching the supporting means.

According to the present invention, there is also provided an electrophotographic printing machine of the type having a developer unit adapted to develop an electrostatic latent image recorded on a photoconductive member, wherein the developer unit comprises a housing defining a chamber for storing a supply of magnetic particles therein and a member having an axis. The developer unit also comprises means for supporting the member at least partially in the chamber of the housing for rotation substantially about the axis thereof and a magnetic member. The magnetic member includes a plurality of magnetic poles with magnetization axes extending in a direction substantially transverse to the axis of the member to form a seal of magnetic particles between the housing and the member to prevent contaminants from reaching the supporting means.

Figure 5:
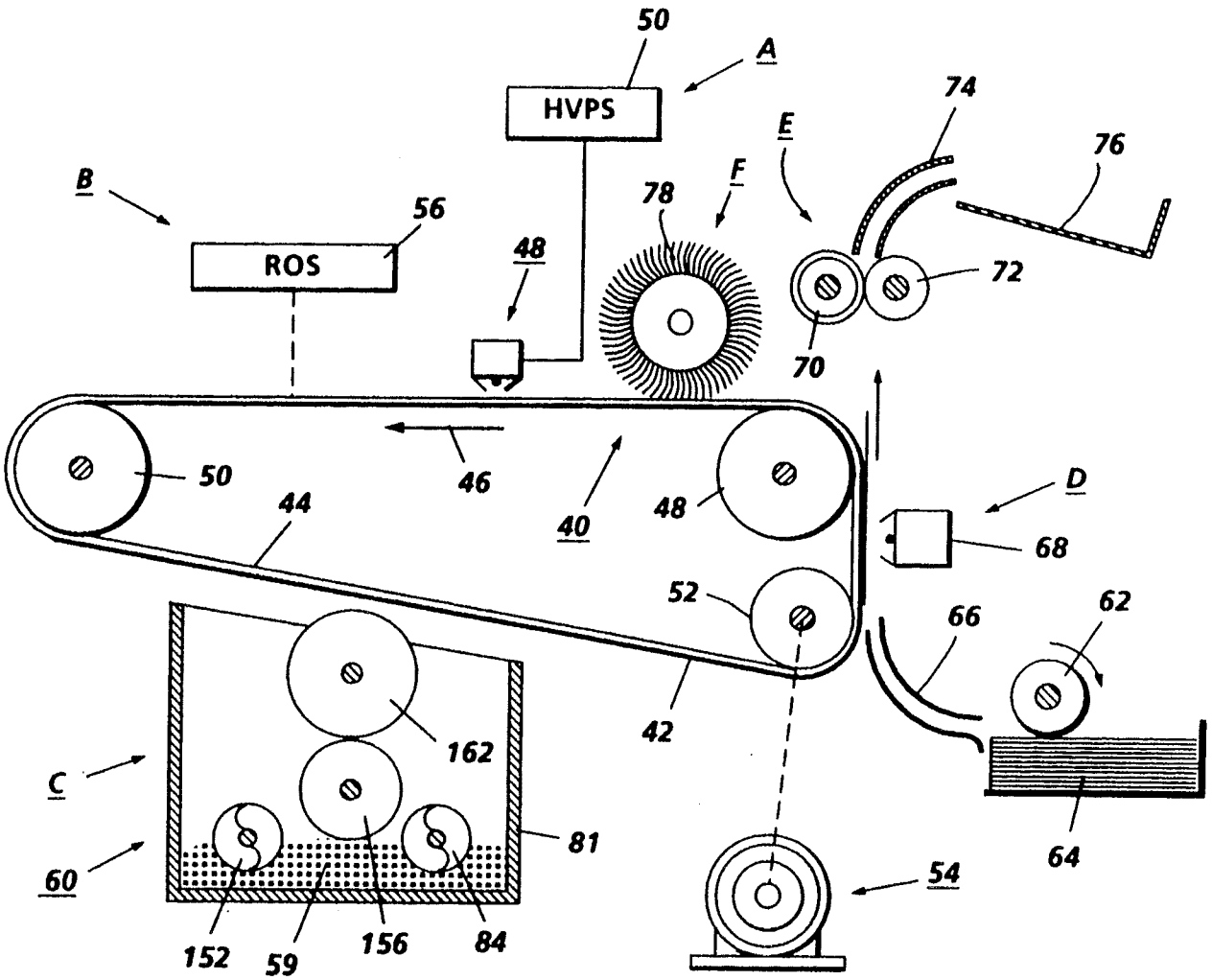
Figure 6:
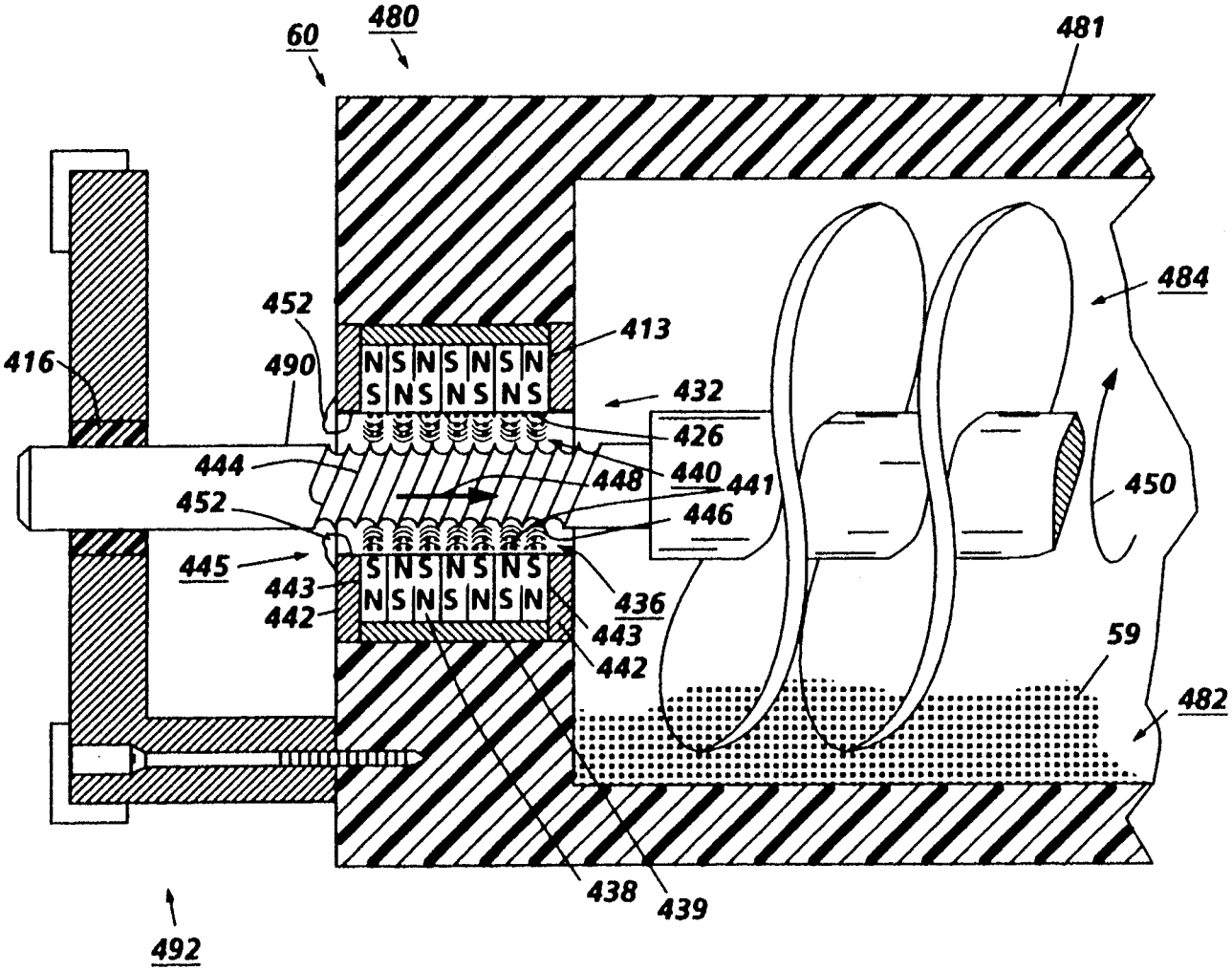

FIG. 5 is a schematic elevational view of an illustrative electrophotographic printing machine incorporating the multi-pole seal configuration of the development apparatus of the present invention therein; and FIG. 6 is a partial sectional view of yet another multi-pole magnetic seal configuration utilizing a flexible multi-pole magnetic strip, an external bearing housing and a spiral toner passageway for a development housing according to the present invention.

Figure 7:
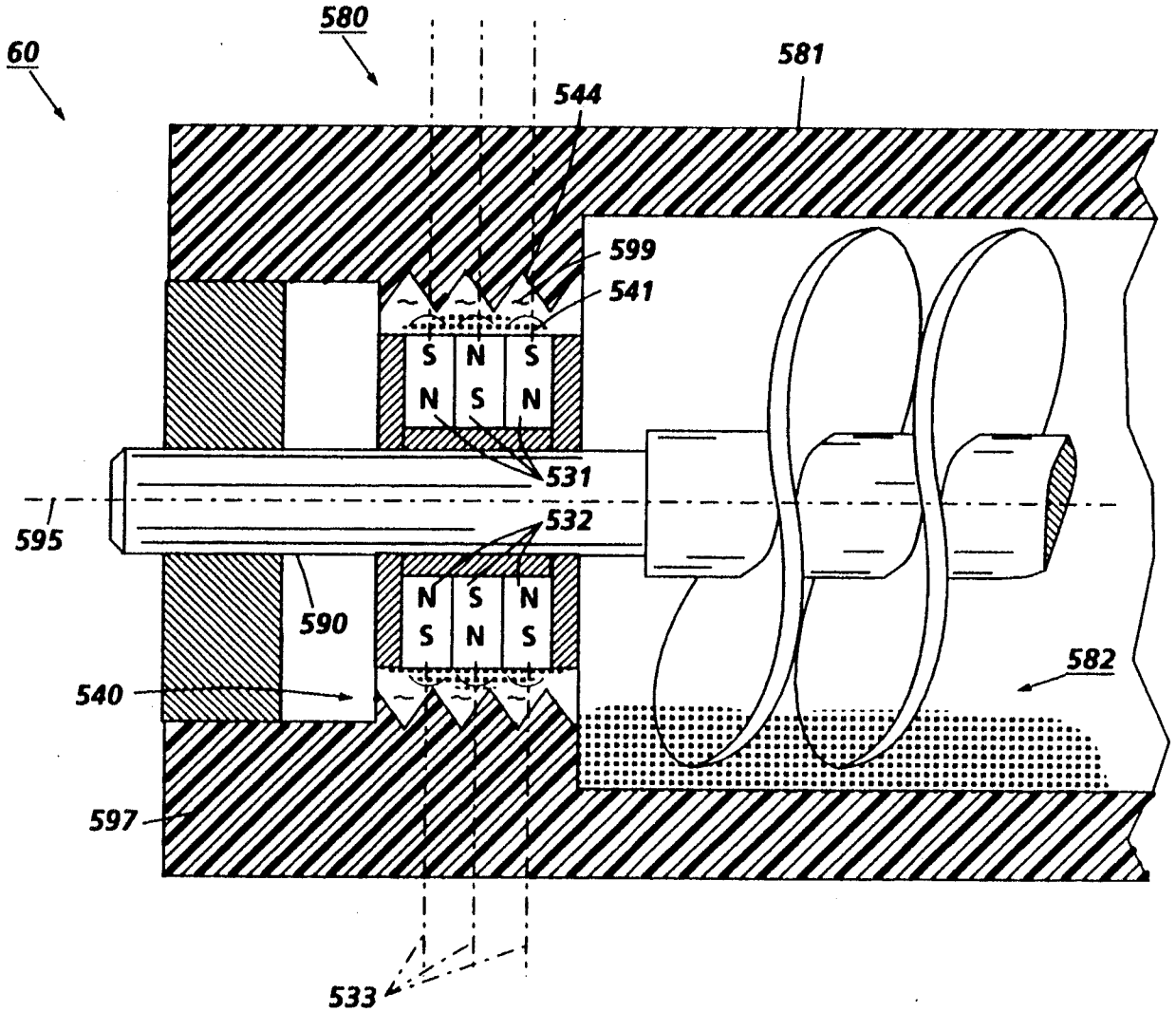

FIG. 7 is a partial sectional view of a multi-pole magnetic seal configuration in which a housing having a spiral groove is utilized.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 5 printing machine will be shown hereinafter schematically and their operation described briefly with reference thereto.

Referring initially to FIG. 5, there is shown an illustrative electrophotographic printing machine incorporating the development apparatus of the present invention therein. The printing machine incorporates a photoreceptor 40 in the form of a belt having a photoconductive surface layer 42 on an electroconductive substrate 44. Preferably the surface 42 is made from a selenium alloy. The substrate 44 is preferably made from an aluminum alloy which is electrically grounded. The belt is driven by means of motor 54 along a path defined by rollers 48, 50 and 52, the direction of movement being counter-clockwise as viewed and as shown by arrow 46. Initially a portion of the belt 40 passes through a charge station A at which a corona generator 48 charges surface 42 to a relatively high, substantially uniform, potential. A high voltage power supply 50 is coupled to device 48.

Next, the charged portion of photoconductive surface 42 is advanced through exposure station B. At exposure station B, ROS 56 lays out the image in a series of horizontal scan lines with each line having a specified number of pixels per inch. The ROS includes a laser having a rotating polygon mirror block associated therewith. The ROS exposes the charged photoconductive surface of the printer.

After the electrostatic latent image has been recorded on photoconductive surface 42, belt 40 advances the latent image to development station C as shown in FIG. 5. At development station C, a development system or developer unit 60, develops the latent image recorded on the photoconductive surface. The chamber in developer housing 81 stores a supply of developer material 59. The developer material 59 may be a two component developer material of at least magnetic carrier granules having toner particles adhering triboelectrically thereto. It should be appreciated that the developer material may likewise comprise a one component developer material consisting primarily of toner particles.

Again referring to FIG. 5, after the electrostatic latent image has been developed, belt 40 advances the developed image to transfer station D, at which a copy sheet 64 is advanced by roll 62 and guides 66 into contact with the developed image on belt 40. A corona generator 68 is used to spray ions on to the back of the sheet so as to attract the toner image from belt 40 to the sheet. As the belt turns around roller 48, the sheet is stripped therefrom with the toner image thereon.

After transfer, the sheet is advanced by a conveyor (not shown) to fusing station E. Fusing station E includes a heated fuser roller 70 and a back-up roller 72. The sheet passes between fuser roller 70 and back-up roller 72 with the toner powder image contacting fuser roller 70. In this way, the toner powder image is permanently affixed to the sheet. After fusing, the sheet advances through chute 74 to catch tray 76 for subsequent removal from the printing machine by the operator.

After the sheet is separated from photoconductive surface 42 of belt 40, the residual developer material adhering to photoconductive surface 42 is removed therefrom at cleaning station F by a rotatably mounted fibrous brush 78 in contact with photoconductive surface 42. Subsequent to cleaning, a discharge lamp (not shown) floods photoconductive surface 42 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 1:
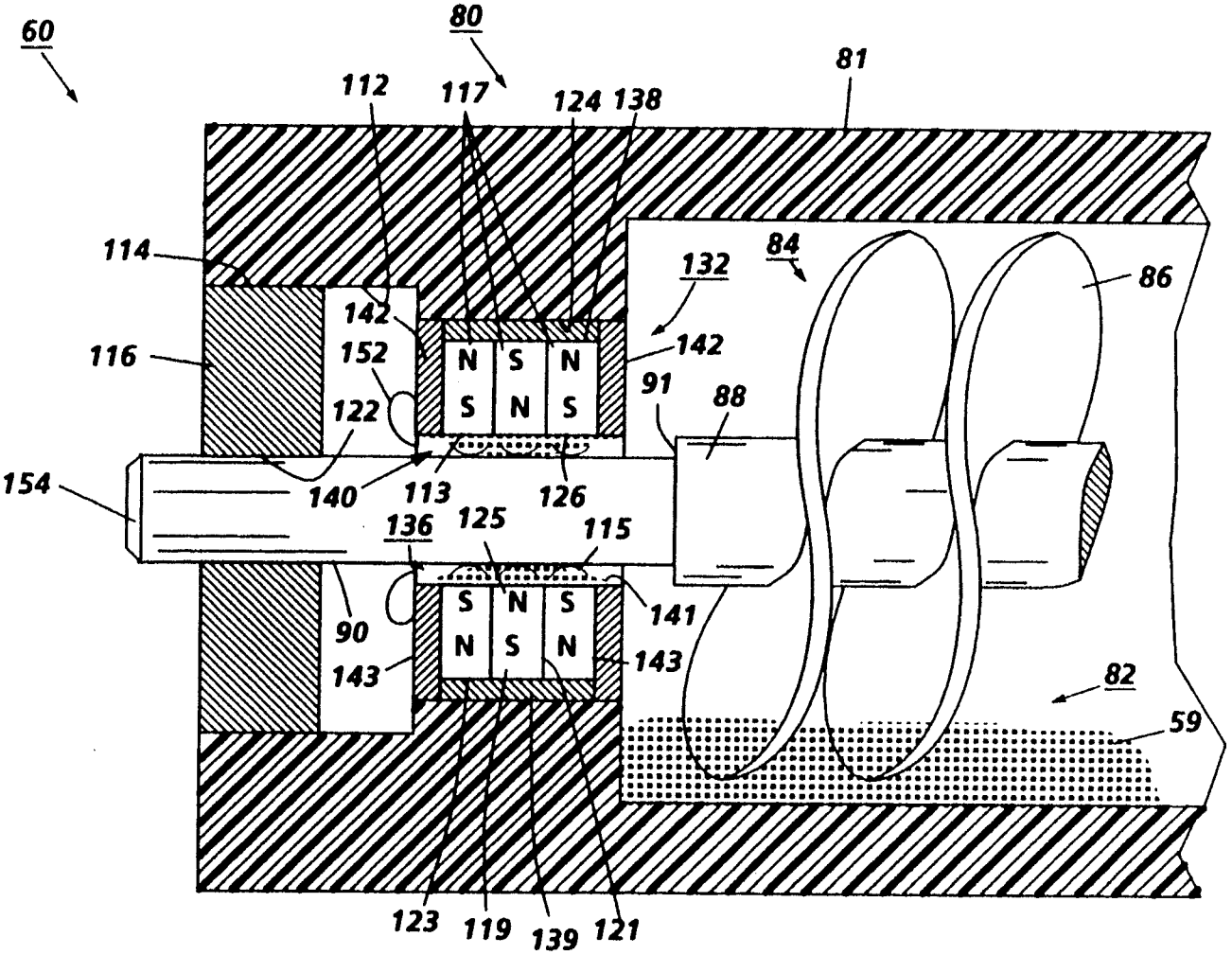
FIG. 1 is a partial sectional view of a multi-pole magnetic seal configuration for a development housing according to the present invention.

According to the present invention and referring to FIG. 1, an apparatus 80 for sealing a shaft is shown incorporated into the developer unit 60. Developer housing 81 forms chamber 82 in which developer material 59 is stored. Auger 84 is located within the chamber 82 to distribute, agitate, and triboelectrically charge the developer material 59. The auger 84 may have any suitable shape, but typically, includes paddles 86 which extend from a centrally located auger shaft 88. Auger journal 90 extend outwardly from end 91 of the auger shaft 88 and serve to support the auger 84.

The developer housing 81 can be made from any suitable durable material, such as a metal, durable plastic, or a composite material. For example, the developer housing 81 may be inexpensively made of molded plastic.

A bearing outer periphery 114 of a bearing 116 may either be slidably fitted within a bearing housing bore 112 or be interference fitted thereto depending upon the loads generated from the auger 84. The bearing 116 may be any suitable durable bearing such as a rolling element bearing, a journal bearing, or a sleeve bearing. The bearing 116 may be a greased radial ball bearing with lip seals, but preferably, the bearing 116 is a shielded or low friction sealed bearing or an unsealed bearing. To minimize the cost of the bearing 116 and to provide a low friction bearing, the bearing 116 may be a sleeve bearing having a non-stick surface such as Teflon ®. The sleeve bearing may include an internal ridge (not shown) to seal closely against the journal 90. The bearing 116 includes a bearing bore 122 to which the auger journal 90 matingly fits.

Referring again to FIG. 1, a seal housing bore 124 in the housing 81 is generally concentric with the bearing housing bore 112. A developer housing seal 132 is securely fitted to the seal housing bore 124 at an outer periphery 138 of the seal 132 by an interference fit or secured by other means such as adhesive or a set screw (not shown). The auger journal 90 fits through a seal bore 126 of the developer housing seal 132 and extends into the bearing bore 122 of the bearing 116. The developer housing seal 132 is used to seal the developer material 59 within the chamber 82. The seal 132 is spaced from the journal 90 with a space 136 being formed between the seal bore 126 of the seal 132 and the journal 90. The seal bore 126 seals against the journal 90.

The developer seal 132 is preferably made from a magnetic or magnetizable material. A magnetic field 140 formed in the space 136 between the seal bore 126 and the journal 90 attracts a quantity of carrier granules 141 to the space 136 to form a curtain of carrier granules that inhibit the progression of the developer material 59 through the space 136. The seal 132 may include shunts or shapers 142 in the form of magnetizable washers on faces 143 of the seal 132 to assist in directing the magnetic field 140. The shunts may also include a magnetizable ring 139 fitted over the seal outer periphery 138.

The developer seal 132 includes more than one magnetic pole 113 along the length of journal 90 in order that the magnetic field 140 includes more than one lobe 115. A plurality of lobes serves to improve the efficiency of the seal 132 permitting the use of smaller, less expensive, weaker magnets with thinner cross sections. The magnetic field 140 at the surface of the journal 91 must be strong enough to keep the carrier granules 141 suspended in the magnetic field to form the seal, yet weak enough to avoid having the carrier granules 141 score the journal surface and to avoid the generation of excessive heat from eddy currents generated between the rotating journal 90 and the stationary magnetic housing seal 132. The magnetic housing seal 132 with the plurality of poles generate a magnetic field 140 which has an intensity which decrease more rapidly than a single pole magnetic seal in a direction away from the surface of the magnets.

The magnetic field which is strong enough to keep the carrier granules 141 suspended in the magnetic field to form the seal, yet weak enough to avoid having the carrier granules 141 score the journal surface and to avoid the generation of excessive heat from eddy currents generated between the rotating journal 90 is closer to the seal bore 126 of a multi-pole magnet than that of a single pole magnet. The distance between the seal bore 126 and the journal surface in a multi-pole magnet is much less than the corresponding distance in a single pole magnet.

Since the intensity of a multi-pole magnet magnetic field decreases more rapidly than a single pole magnet in the direction away from the magnet, the eddy currents generated from a multi-pole magnetic seal between the journal 90 and the magnetic seal 132 are greatly reduced and the resulting heat generated therefrom is likewise reduced. Since the distance between the seal bore 126 and the journal surface in a multi-pole magnet is much less than the corresponding distance in a single pole magnet and since the cross section of a multi-pole magnet is less than the cross section of a single pole magnet, the size and overall dimensions of a developer unit can be reduced using multi-pole magnetic seals. This ability to reduce the size of developer units is particularly valuable for multi-color machines which have a multitude of developer units which must be placed adjacent the photoreceptive element.

Further by providing a seal with multiple lobes 115 the magnetic field around the outer of faces 143 at zone 152 is less attracting fewer carrier granules 141 to the outside of the seal 132 which may lose their magnetic bond to the seal 132 and migrate to the bearing 116 causing damage thereto.

The multi-pole developer seal 132 may be made of any suitable magnetic or magnetizable material such as a permanent magnet or a temporary magnet. A number of the poles 113 greater than one may be used. As shown in FIG. 1, the seal 132 consists of two outer magnets 117 and one inner magnet 119. The magnets 117 and 119 each have a washer shape with flat parallel faces 121 and a cylindrical outer periphery 123 which is concentric with a cylindrical bore 125. The outer magnets 117 have an inner south pole and an outer north pole and the inner magnet 119 has an inner north pole and an outer south pole. The magnets 117 and 119 thus form magnetic field 140 which has several lobes 115.

The auger journal 90 may merely extend through the bearing 116 or, as shown in FIG. 1, may have an end 154 which extends considerably beyond the bearing 116. A drive member (not shown), such as a gear may be matingly fitted to the auger journal 90 in the area outboard of the developer housing 81 and near the end 154 of the journal 90. The gear may be connected to a drive means (not shown) used to transmit torque to the auger 84.

Now referring again to FIG. 5, auger 84 is shown located in developer housing 81. The auger 84 includes seal 132 (see FIG. 1). Likewise, the seal 132 may be used to support a second auger 152, a transport roller 156, and a developer roller 162.

Figure 2:
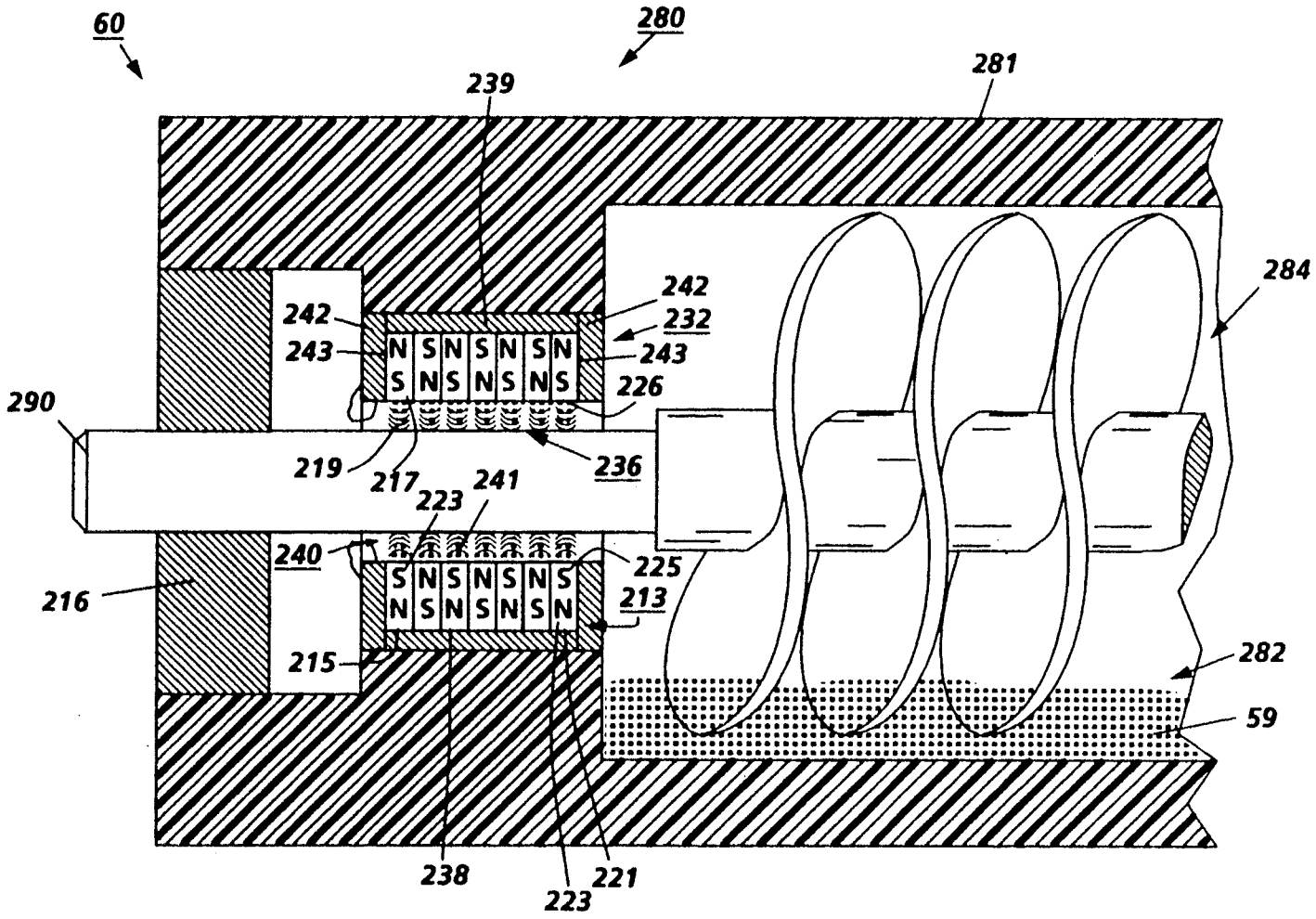
FIG. 2 is a partial sectional view of another multi-pole magnetic seal configuration utilizing a flexible multi-pole magnetic strip for a development housing according to the present invention.

Now referring to FIG. 2, another alternative embodiment of the invention is shown in apparatus 280 for sealing a shaft in the developer unit 60. Apparatus 280 is similar to apparatus 80 of FIG. 1, except that rather than having the seal 132 comprised of two washer shaped outer magnets 117 and one washer shaped inner magnet 119, a seal 232 is made of a flexible strip 213 which has seven (7) strip sections 215 therein each with a different polarity, which strip 213 is formed into a ring to make the seal 232.

A developer housing 281 defines a chamber 282 which contains a supply of developer material 59. An auger 284 is used to transfer, agitate, an triboelectrically charge the developer material 59 within the chamber 282. The auger 284 contains a journal 290 which is used to support the auger 284. The auger journal 290 extends through a seal bore 226 in the seal 232. The seal 232 serves to prevent the migration of the developer material 59 from the chamber 282.

The developer seal 232 is preferably made from a magnetic or magnetizable material. A magnetic field 240 is formed in a space 236 between the seal bore 226 and the journal 290. The magnetic field 240 attracts a quantity of carrier granules 241 to the space 236 to form a curtain of carrier granules that inhibit the progression of the developer material 59 through the space 236. The seal 232 may include shunts or shapers 242 in the form of magnetizable washers on faces 243 of the seal 232 to assist in directing the magnetic field 240. The shunts may also include a magnetizable ring 239 fitted over a seal outer periphery 238.

The developer seal, 232 includes more than one magnetic pole 217 along the length of the journal 290 in order that the magnetic field 240 includes more than one lobe 219. A plurality of lobes 219 serves to improve the efficiency of the seal 232 permitting the use of less expensive weaker magnets and permitting greater distances between the seal 232 and the journal 290. The greater distances and weaker magnets reduce the force required to rotate the journal and the resulting heat generated therefrom. Further, the use of weaker fields and greater distances reduces the eddy current generated between the journal 290 and the magnetic seal 232 and the resulting heat generated therefrom. Further, by providing a seal with multiple lobes 219, the magnetic field around the outer of the faces 243 is less, thereby attracting fewer carrier granules 241 to the outside of the seal 232 which may lose their magnetic bond to the seal 232 and migrate to the bearing 216 causing damage thereto.

The multi-pole developer seal 232 may be made of any suitable magnetic or magnetizable material such as a permanent magnet or a temporary magnet. A number of poles 217 greater than one may be used. The seal 232 is preferably made of a flexible magnetic strip 213 which has seven (7) strip sections 215 which form the seven poles 217. The strip 213 is made of any suitable flexible magnetic or magnetizable material such as commercially available magnetic tape.

Figure 3B:
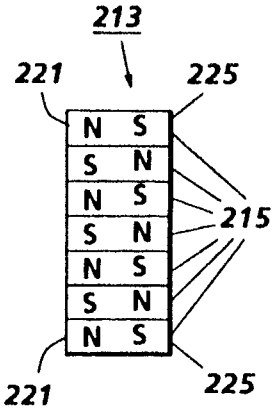
FIG. 3B is a plan view of a flexible multi-pole magnetic strip for use in a multi-pole magnetic seal.
Figure 3A:
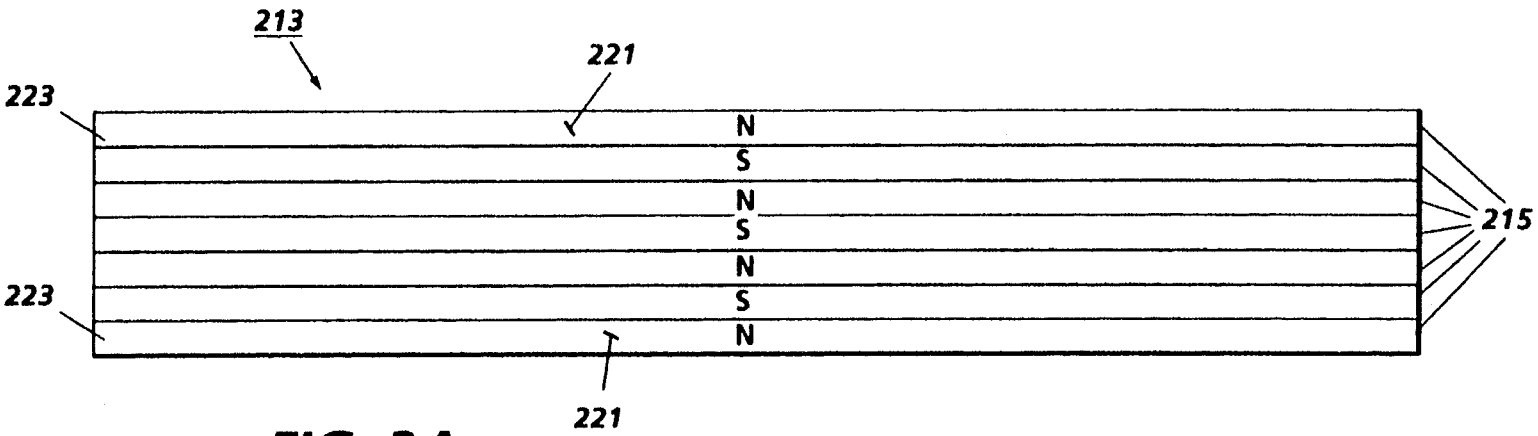
FIG. 3A is a top view of a flexible multi-pole magnetic strip for use in a multi-pole magnetic seal.
Figure 3C:
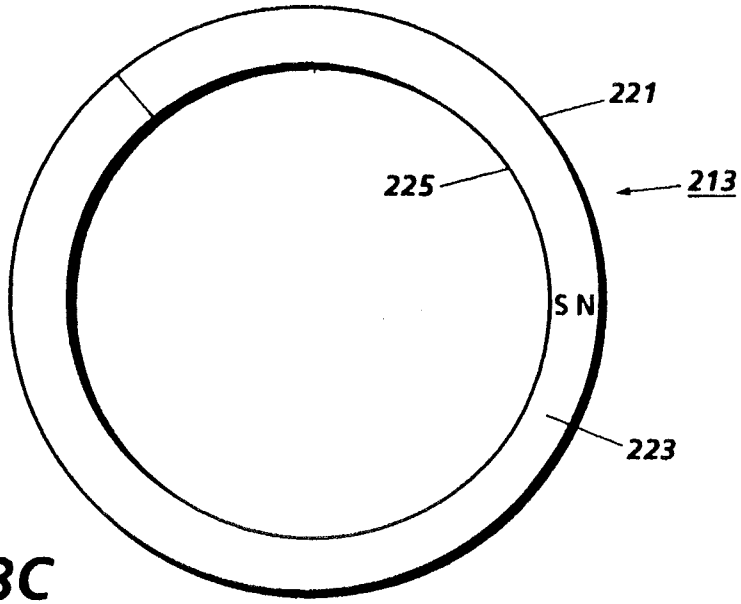
FIG. 3C is a plan view of a flexible multi-pole magnetic strip formed into a ring for use in a multi-pole magnetic seal.
Figure 4:
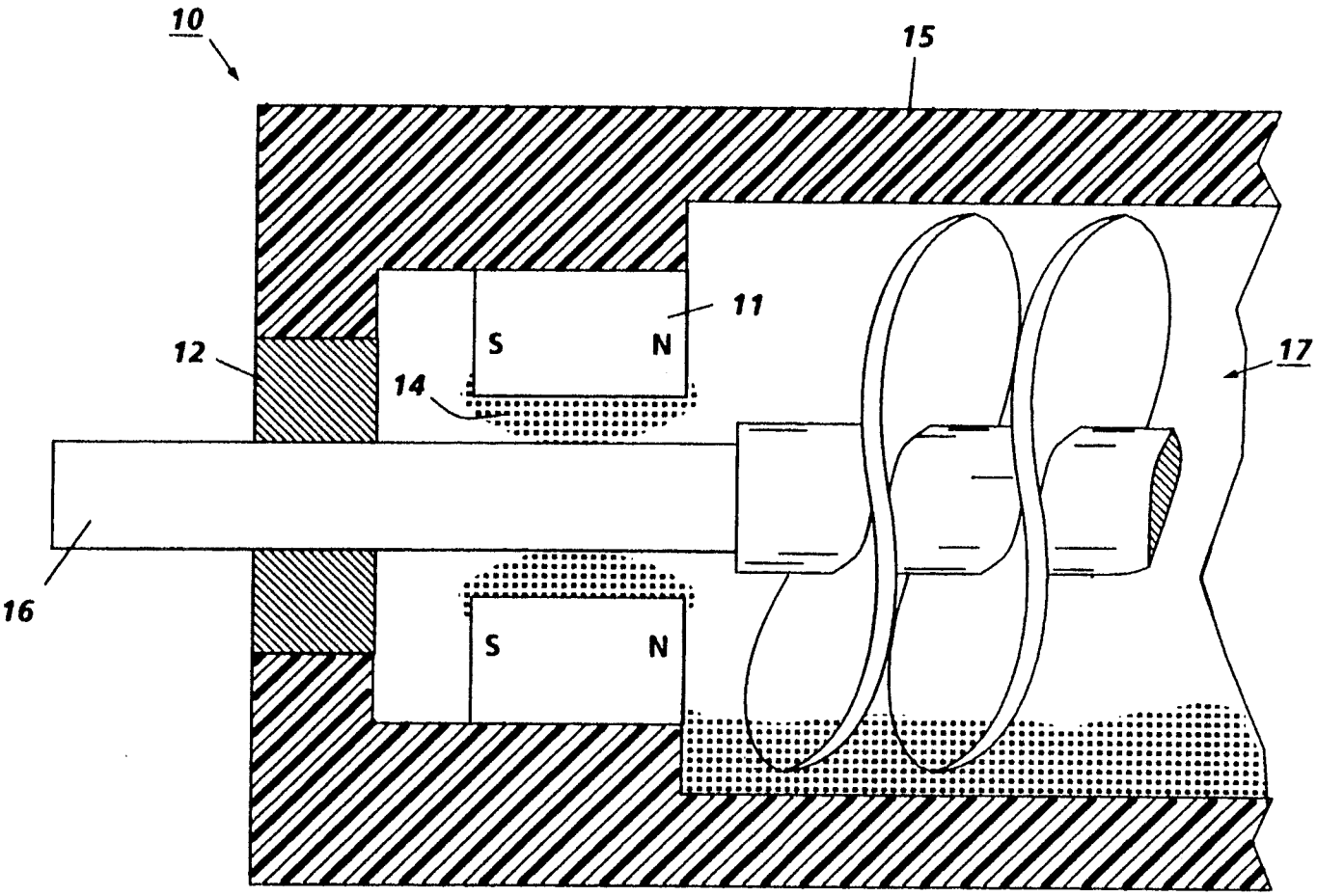
FIG. 4 PRIOR ART
FIG. 4 is a partial sectional view of a prior art single pole seal configuration for a development housing.

Now referring to FIG. 3A, the strip 213 is shown in more detail. The strip 213 includes seven (7) strip sections 215. It should be appreciated that the invention may be practiced with as few as two sections. An outer face 221 of end strip sections 223 of the strip 213 has a north polarity, while an inner face 225 of the end strip sections 223 has a south polarity. Each face of each section 215 has a polarity opposite to that of the adjacent section. The arrangement of the polarities of the sections 215 is best shown referring to FIG. 3B. Referring to FIG. 3C the flexible strip 213 is shown formed into a ring shape with the polarities of the end strip sections 223 as shown.

Referring again to FIG. 2, the strip 213 is shown installed into the seal 232 with the polarities of the seven (7) strip sections 215 shown. The seven (7) sections 215 form the seven (7) poles 217 and the corresponding lobes 219.

Extending outboard of the seal 232 is a bearing 216 which is slidably fit to the auger journal 290. Preferably, as with the bearing 116 of FIG. 1, bearing 216 is a sleeve bearing.

Now referring to FIG. 6, another alternative embodiment of the invention is shown in apparatus 480 for sealing a shaft in the developer unit 60. Apparatus 480 is similar to the apparatus 280 of FIG. 2, except that the apparatus 480 further includes a spiral passageway 445 defined by threads 444 which are formed in auger journal 490 for drawing carrier granules 441 into a developer housing 481. The apparatus 480 also includes a thermally conductive support structure 492 for dissipating heat from a bearing 416.

The developer housing 481 defines a chamber 482 which contains a supply of developer material 59. An auger 484 is used to transfer, agitate, and triboelectrically charge the developer material 59 within the chamber 482. The auger 484 contains journal 490 which is used to support the auger 484. The auger journal 490 extends through a seal bore 426 in a developer housing seal 432. The seal 432 serves to prevent the migration of the developer material 59 from the chamber 482.

The apparatus 480 serves to support the auger journal 490 of the developer unit 60. The apparatus 480 includes the support structure or support member 492 which is preferably in the form of a bearing block.

The bearing 416 may be any suitable durable bearing such as a rolling element bearing, a journal bearing, or a sleeve bearing. The bearing 416 may be a greased radial ball bearing with lip seals, but preferably, the bearing 416 is a shielded or low friction sealed bearing or an unsealed bearing. To minimize the cost of the bearing 416 and to provide a low friction bearing, the bearing 416 may be a sleeve bearing having a non-stick surface such as Teflon ®.

The developer seal 432 is preferably made from a magnetic or magnetizable material. The seal 432 is substantially the same as seal 232 of FIG. 2, being made of a flexible strip 413 similar to strip 213 of FIG. 2. A magnetic field 440 is formed in a space 436 between the seal bore 426 and the journal 490. The magnetic field 440 attracts a quantity of carrier granules 441 to the space 436 to form a curtain of carrier granules that inhibit the progression of the developer material 59 through the space 436. The seal 432 may include shunts or shapers 442 in the form of magnetizable washers on faces 443 of the seal 432 to assist in directing the magnetic field 440. The shunts may also include a magnetizable ring 439 fitted over a seal outer periphery 438.

An outer layer of the carrier granules 441 may extend beyond crests 446 of the threads 444 which form the spiral passageway. The threads 444 have either a right hand spiral or a left hand spiral depending on the rotation of journal 490 in order that the crests 446 move the carrier granules 441 inwardly in the direction of an arrow 448 when the journal is rotated in its normal operating direction in the direction of an arrow 450. Carrier granules 441 which are located in a zone 452 outboard of the seal 432 are drawn by the threads 444 to the chamber 482. The threads 444 serve to remove excess carrier granules 441 and thus to reduce the torque required to rotate the journal 490. It should be appreciated that threads for seal (not shown) surrounding journal 490 on the opposite end of auger 484 will have the opposite hand spiral of the other end of the auger 484 to assure the carrier granules 441 are drawn by the threads into the chamber 482.

According to the present invention and referring now to FIG. 7, an apparatus 580 for sealing a rotating member such as a shaft 590 and for removing contaminants 599 is shown incorporated into the developer unit 60 of an electrophotographic printing machine (see FIG. 5). Referring again to FIG. 7, the apparatus 580 is similar to apparatus 80 of FIG. 1 except as described hereinafter and as shown in FIG. 7. The apparatus 580 is used to seal the elongated shaft 590 mounted in a support 597 to rotate about an axis 595 thereof. The apparatus 580 is at least partially in a chamber 582 of a housing 581 with magnetic particles 541 being disposed at least in a region 540 between the housing 581 and the shaft 590. The apparatus includes a magnetic member 532 having a plurality of magnetic poles 531 with magnetization axes 533 extending in a direction substantially transverse to the axis 595 of the shaft 590. The magnetic member 532 is mounted on the shaft. The housing includes a spiral groove 544 extending over a portion thereof opposed from the magnetic member to move the contaminants 599 away from the support 597.

While the apparatuses 80, 280 and 480 as shown in FIGS. 1, 2 and 6, respectively, show an apparatus which supports an auger, it should be readily appreciated that the apparatuses 80, 280 and 480 may serve equally as well to seal magnetic or nonmagnetic transport or developing rolls.

The apparatuses 80, 280 and 480 as shown in FIGS. 1, 2 and 6, respectively, show an apparatus for use in a developer unit of an electrophotographic printing machine. It should be appreciated that the seals 80, 280 and 480 may likewise be used to seal a support member whether the support member is adjacent to a chamber containing a magnetic or nonmagnetic material or even if the support member is not adjacent to a chamber. The magnetizable material needed to interact with the magnetic field to form the seal may be purposely added to the seal to effectuate a multi-pole magnetic seal within the scope of the invention for sealing a space between any two members.

A plurality of lobes serves to improve the efficiency of the seal permitting the use of thinner, less expensive, weaker magnets. Further, the intensity of a multi-pole magnet magnetic field decreases more rapidly than a single pole magnet in the direction away from the magnet. The eddy currents generated from a multi-pole magnetic seal between the journal and the magnetic seal are greatly reduced and the resulting heat generated therefrom is likewise reduced. Since the distance between the seal bore and the journal surface in a multi-pole magnet is much less than the corresponding distance in a single pole magnet and since the cross section of a multi-pole magnet is less than the cross section of a single pole magnet, the size and overall dimensions of a developer unit can be reduced using multi-pole magnetic seals. This ability to reduce the size of developer units is particularly valuable for multi-color machines which have a multitude of developer units which muct be placed adjacent the photoreceptive element. Further by providing a seal with multiple lobes the magnetic field around the outer of faces is less attracting fewer carrier granules to the outside of the seal which may lose their magnetic bond to the seal and migrate to the bearing causing damage thereto.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. A system for sealing a rotating member mounted in a support to rotate about an axis thereof and being at least partially in a chamber of a housing with magnetic particles being disposed at least in a region between the housing and the rotating member, comprising a magnetic member including a plurality of magnetic poles, said poles establishing magnetic fields to form a plurality of spaced apart seals of magnetic particles extending along the axis between the housing and the rotating member to prevent contaminants from reaching the support.

2. A system as in claim 1, wherein the rotating member comprises an elongated shaft.

3. A system as in claim 2, wherein the support comprises a bearing.

4. A system as in claim 2, wherein said magnetic member comprises a plurality of radially magnetized ring shaped members with adjacent magnetic poles of adjacent ring shaped members being of opposite polarity.

5. A system as in claim 4, wherein said plurality of ring shaped members are mounted on said housing in the chamber thereof.

6. A system for sealing an elongated shaft mounted in a support to rotate about an axis thereof and being at least partially in a chamber of a housing with magnetic particles being disposed at least in a region between the housing and the shaft, comprising a magnetic member including a plurality of magnetic poles with magnetization axes extending in a direction substantially transverse to the axis of the shaft, said magnetic member being mounted in said housing and the shaft including a spiral groove extending over a portion thereof opposed from said magnetic member to move contaminants away from the support.

7. A system for sealing an elongated shaft mounted in a support to rotate about an axis thereof and being at least partially in a chamber of a housing with magnetic particles being disposed at least in a region between the housing and the shaft, comprising a magnetic member including a plurality of magnetic poles with magnetization axes extending in a direction substantially transverse to the axis of the shaft, said magnetic member being mounted on the shaft and the housing including a spiral groove extending over a portion thereof opposed from said magnetic member to move contaminants away from the support.

8. A system for sealing an elongated shaft mounted in a support to rotate about an axis thereof and being at least partially in a chamber of a housing with magnetic particles being disposed at least in a region between the housing and the elongated shaft, comprising a plurality of radially magnetized ring shaped members including a plurality of magnetic poles with magnetization axes extending in a direction substantially transverse to the axis of the shaft with adjacent magnetic poles of adjacent ring shaped members being of opposite polarity, said plurality of ring shaped members being mounted on the elongated shaft in the chamber of said housing.

9. A developer unit, comprising:

a housing defining a chamber for storing a supply of magnetic particles therein;

a rotating member having an axis;

means for supporting said rotating member at least partially in the chamber of said housing for rotation substantially about the axis thereof; and a magnetic member including a plurality of magnetic poles, said poles establishing magnetic fields to form a plurality of spaced apart seals of magnetic particles extending along the axis between said housing and said rotating member to prevent contaminants from reaching said supporting means.

10. A developer unit as in claim 9, wherein said rotating member comprises an elongated shaft.

11. A developer unit as in claim 10, wherein said supporting means includes a bearing.

12. A developer unit as in claim 10, wherein said magnetic member comprises a plurality of radially magnetized ring shaped members with adjacent magnetic poles of adjacent ring shaped members being of opposite polarity.

13. A developer unit as in claim 12, wherein said plurality of ring shaped members are mounted on said housing in the chamber thereof.

14. A developer unit, comprising:

a housing defining a chamber for storing a supply of magnetic particles therein;

an elongated shaft having an axis;

means for supporting said elongated shaft at least partially in the chamber of said housing for rotation substantially about the axis thereof,; and a magnetic member including a plurality of magnetic poles with magnetization axes extending in a direction substantially transverse to the axis of said elongated shaft to form a seal of magnetic particles between said housing and said elongated shaft to prevent contaminants from reaching said supporting means, said magnetic member being mounted in said housing and said shaft including a spiral groove extending over a portion thereof opposed from said magnetic member to move the contaminants away from said supporting means.

15. A developer unit, comprising:

a housing defining a chamber for storing a supply of magnetic particles therein;

an elongated shaft having an axis;

means for supporting said elongated shaft at least partially in the chamber of said housing for rotation substantially about the axis thereof,; and a magnetic member including a plurality of magnetic poles with magnetization axes extending in a direction substantially transverse to the axis of said elongated shaft to form a seal of magnetic particles between said housing and said elongated shaft to prevent contaminants from reaching said supporting means, said magnetic member being mounted on said shaft and said housing including a spiral groove extending over a portion thereof opposed from said magnetic member to move the contaminants away from said supporting means.

16. A developer unit, comprising:

a housing defining a chamber for storing a supply of magnetic particles therein;

an elongated shaft having an axis;

means for supporting said elongated shaft at least partially in the chamber of said housing for rotation substantially about the axis thereof; and a plurality of radially magnetized ring shaped members including a plurality of magnetic poles with magnetization axes extending in a direction substantially transverse to the axis of said elongated shaft to form a seal of magnetic particles between said housing and said elongated shaft to prevent contaminants from reaching said supporting means with adjacent magnetic poles of adjacent ring-shaped members being of opposite polarity, said plurality of ring shaped members being mounted on said elongated shaft in the chamber of said housing.

17. An electrophotographic printing machine of the type having a developer unit adapted to develop an electrostatic latent image recorded on a photoconductive member, wherein said developer unit comprises:

a housing defining a chamber for storing a supply of magnetic particles therein;

a rotating member having an axis;

means for supporting said rotating member at least partially in the chamber of said housing for rotation substantially about the axis thereof; and a magnetic member including a plurality of magnetic poles, said poles establishing magnetic fields to form a plurality of spaced apart seals of magnetic particles extending along the axis between said housing and said rotating member to prevent contaminants from reaching said supporting means.

18. A printing machine as in claim 17, wherein said rotating member comprises an auger.

19. A printing machine as in claim 17, wherein said supporting means includes a bearing.

20. A printing machine as in claim 17, wherein said magnetic member comprises a plurality of radially magnetized ring shaped members with adjacent magnetic poles of adjacent ring shaped members being of opposite polarity.

21. A printing machine as in claim 20, wherein said plurality of ring shaped members are mounted on said housing in the chamber thereof.

22. An electrophotographic printing machine of the type having a developer unit adapted to develop an electrostatic latent image recorded on a photoconductive member, wherein said developer unit comprises:

a housing defining a chamber for storing a supply of magnetic particles therein;

a rotating member having an axis;

means for supporting said rotating member at least partially in the chamber of said housing for rotation substantially about the axis thereof; and a magnetic member including a plurality of magnetic poles with magnetization axes extending in a direction substantially transverse to the axis of said rotating member to form a seal of magnetic particles between said housing and said rotating member to prevent contaminants from reaching said supporting means, said magnetic member being mounted in said housing and said rotating member including a spiral groove extending over a portion thereof opposed from said magnetic member to move the contaminants away from said supporting means.

23. An electrophotographic printing machine of the type having a developer unit adapted to develop an electrostatic latent image recorded on a photoconductive member, wherein said developer unit comprises:

a housing defining a chamber for storing a supply of magnetic particles therein;

a rotating member having an axis;

means for supporting said rotating member at least partially in the chamber of said housing for rotation substantially about the axis thereof; and a magnetic member including a plurality of magnetic poles with magnetization axes extending in a direction substantially transverse to the axis of said rotating member to form a seal of magnetic particles between said housing and said rotating member to prevent contaminants from reaching said supporting means, said magnetic member being mounted on said rotating member and said housing including a spiral groove extending over a portion thereof opposed from said magnetic member to move the contaminants away from said supporting means.

24. An electrophotographic printing machine of the type having a developer unit adapted to develop an electrostatic latent image recorded on a photoconductive member, wherein said developer unit comprises:

a housing defining a chamber for storing a supply of magnetic particles therein;

a rotating member having an axis;

means for supporting said rotating member at least partially in the chamber of said housing for rotation substantially about the axis thereof; and a plurality of radially magnetized ring shaped members with adjacent magnetic poles of adjacent ring shaped members being of opposite polarity including a plurality of magnetic poles with magnetization axes extending in a direction substantially transverse to the axis of said rotating member to form a seal of magnetic particles between said housing and said rotating member to prevent contaminants from reaching said supporting means, said plurality of ring shaped members being mounted on said rotating member in the chamber of said housing.

* * * * *